US008776872B2

(12) United States Patent
Capelle et al.

(10) Patent No.: US 8,776,872 B2
(45) Date of Patent: Jul. 15, 2014

(54) EXHAUST GAS HEAT EXCHANGER WITH INTEGRATED MOUNTING INTERFACE

(75) Inventors: Andreas Capelle, Pulheim (DE); Oliver Fischer, Aachen (DE); Peter Diehl, Cologne (DE); Michael Gauss, Cologne (DE); Andrej Repa, Trencin (SK); Guillaume Hebert, Uherske Hradiste (CZ)

(73) Assignee: Halla Visteon Climate Control Corporation, Daejeon-si (KR)

( * ) Notice: Subject to any disclaimer, the term of this patent is extended or adjusted under 35 U.S.C. 154(b) by 1473 days.

(21) Appl. No.: 12/171,425

(22) Filed: Jul. 11, 2008

(65) Prior Publication Data

US 2009/0013677 A1 Jan. 15, 2009

(30) Foreign Application Priority Data

Jul. 11, 2007 (DE) ..... 10 2007 032 187
May 8, 2008 (DE) ..... 10 2008 001 659

(51) Int. Cl.

| | |
|---|---|
| ***F28D 7/06*** | (2006.01) |
| ***F28F 1/08*** | (2006.01) |
| ***F28F 9/02*** | (2006.01) |
| *F28F 9/007* | (2006.01) |

(52) U.S. Cl.

CPC ... *F05D 7/06* (2013.01); *F28F 1/08* (2013.01); *F28F 9/0219* (2013.01); *F28F 9/007* (2013.01)
USPC ..... 165/163; 165/158; 165/159

(58) Field of Classification Search

USPC ..... 165/158, 163
See application file for complete search history.

(56) References Cited

U.S. PATENT DOCUMENTS

| | | | | | |
|---|---|---|---|---|---|
| 211,166 | A | * | 1/1879 | Lincoln, Jr. | 165/158 |
| 1,363,997 | A | * | 12/1920 | Rapp et al. | 244/123.4 |
| 2,075,708 | A | * | 3/1937 | Evans | 165/163 |
| 2,365,878 | A | * | 12/1944 | Huff | 165/163 |
| 2,499,901 | A | * | 3/1950 | Brown, Jr. | 165/160 |
| 3,131,758 | A | * | 5/1964 | Kern et al. | 165/158 |
| 3,522,840 | A | * | 8/1970 | Wentworth, Jr. | 165/74 |
| 4,221,261 | A | * | 9/1980 | Wunder et al. | 165/74 |
| 4,289,198 | A | * | 9/1981 | Young | 165/159 |
| 5,845,704 | A | * | 12/1998 | Lavelle et al. | 165/163 |
| 6,138,747 | A | * | 10/2000 | Kroger et al. | 165/158 |
| 6,955,213 | B2 | * | 10/2005 | Stonehouse et al. | 165/103 |
| 2004/0238161 | A1 | * | 12/2004 | Al-Anizi et al. | 165/134.1 |
| 2005/0103479 | A1 | * | 5/2005 | Richardson | 165/109.1 |
| 2009/0229802 | A1 | * | 9/2009 | Ishimori et al. | 165/163 |

FOREIGN PATENT DOCUMENTS

| | | | |
|---|---|---|---|
| DE | 100 11 954 | A1 | 9/2001 |
| DE | 10 2004 019 554 | A1 | 11/2005 |
| DE | 10 2006 009 948 | A1 | 10/2006 |
| DE | 10 2005 055 482 | A1 | 5/2007 |
| DE | 10 2006 049 106 | A1 | 6/2007 |

* cited by examiner

*Primary Examiner* — Allen Flanigan
(74) *Attorney, Agent, or Firm* — Fraser Clemens Martin & Miller LLC; J. Douglas Miller

(57) ABSTRACT

A heat exchanger for an exhaust gas train of a motor vehicle with an exhaust gas carrying exchanger tube that is formed separately and is disposed in a closed housing formed separately, a coolant flowing through the housing and around the outer surface of the exchanger tube. The housing includes a housing portion that forms one common mechanical interface for connecting the heat exchanger to the exhaust gas train and a coolant circuit of the motor vehicle.

15 Claims, 5 Drawing Sheets

EXHAUST GAS HEAT EXCHANGER WITH INTEGRATED MOUNTING INTERFACE

CROSS-REFERENCE TO RELATED APPLICATION

This application claims the benefit of German provisional patent application serial no. DE 102007032187.4 filed Jul. 11, 2007, and German non-provisional patent application serial no. DE 102008001659.4 filed May 8, 2008, each of which is hereby incorporated herein by reference in its entirety.

FIELD OF THE INVENTION

The invention relates to a heat exchanger for an exhaust train of a motor vehicle, and more specifically for an exhaust gas recirculation system for an internal combustion engine of a motor vehicle.

BACKGROUND OF THE INVENTION

Due to the ever more stringent legal regulations regarding exhaust emission of motor vehicles, in particular, regarding emission of nitrogen oxides, recirculation of combustion exhaust on the inlet side of the internal combustion engine is state of the art in the field of internal combustion engines. The combustion gases themselves do not participate again in the combustion process in the combustion chamber of the internal combustion engine so that they constitute an inert gas that dilutes the mixture of combustion air and fuel in the combustion chamber and ensure more intimate mixing. It is thus possible to minimize the occurrence of what are termed "hot spots" during the combustion process, the hot spots being characterized by very high local combustion temperatures. Such very high combustion temperatures promote the formation of nitrogen oxides, and must be imperatively avoided.

Since the efficiency of an internal combustion engine is typically dependent on the temperature of the combustion air fed into the combustion chamber of the internal combustion engine, the combustion gases cannot be recirculated to the intake side immediately after having left the combustion chamber of the internal combustion engine. Instead, the temperature of the combustion gas must be significantly lowered. Typically, the temperatures of the combustion gases leaving the combustion chamber of the internal combustion engine are of 900° C. and more. The temperature of the combustion air fed to the combustion chamber of the internal combustion engine on the inlet side should, by contrast, not exceed 150 degrees C., and preferably, be significantly less than that. For cooling the recirculated combustion gases, it is known in the art to utilize what are termed exhaust recirculation coolers. Various constructions are known in the art in which the combustion gases to be cooled are usually circulated through exchanger tubes around the outer side of which a coolant flows, the coolant usually being the cooling water of the motor vehicle. For efficiency increase, it has been proposed in prior art to lead the combustion gases to be cooled through a bundle of exchanger tubes connected in parallel in terms of fluid flow, the coolant generally flowing around the tubes.

From the document DE 10 2004 019 554 A1, an exhaust gas recirculation system for an internal combustion engine is known which includes an exhaust gas heat exchanger implemented as a two-part cast part. Since the very hot combustion gases are reactive due to the fact that the fuel never burns completely, the problem here is that it is technically difficult if not impossible to design the surfaces of a metallic cast part as inert surfaces comparable with a stainless steel surface.

From the document DE 10 2005 055 482 A1 an exhaust gas heat exchanger for an internal combustion engine is known that avoids the problems mentioned above by implementing the surfaces coming into touching contact with the hot combustion gases as non-corrosive steel surfaces. The heat exchanger tubes and the housing accommodating the heat exchanger tubes are configured to be separate parts that are assembled during the manufacturing process.

In the exhaust gas heat exchanger known from the document DE 10 2006 009 948 A1, the channels carrying the hot gas and the housing in which the coolant flowing around the exhaust channels flows are configured integrally in the form of a plate heat exchanger. The flow paths for the hot combustion gases as well as the flow paths for the coolant only form when individual, for example deep-drawn plates are being assembled to form a plate heat exchanger. A similar concept is pursued in the document DE 10 2006 049 106 A1.

General information regarding the technique of exhaust gas recirculation in internal combustion engines may be inferred from the document DE 100 119 54 A1 for example.

It would be desirable to produce a heat exchanger for an exhaust train of a motor vehicle that offers advantages for mounting the heat exchanger in a motor vehicle over the prior art constructions

SUMMARY OF THE INVENTION

Compatible and attuned with the present invention, a heat exchanger for an exhaust train of a motor vehicle that offers advantages for mounting the heat exchanger in a motor vehicle over the prior art constructions, has surprisingly been discovered.

A heat exchanger of the invention is provided for the exhaust train of a motor vehicle having an internal combustion engine. It comprises at least one separately formed exhaust gas carrying exchanger tube that is disposed in a separately formed, closed housing. A coolant flows through the housing and around the outer side of the exchanger tubes. In accordance with the invention, the housing has a housing portion that forms one common mechanical interface S for connecting the heat exchanger to the exhaust gas system as well as to a coolant circuit of the vehicle. The interface S is configured such that, by establishing one unique connection to a suited mounting interface of the motor vehicle, all the connections to the exhaust gas system of the motor vehicle as well as to its coolant circuit are established simultaneously. For this purpose, the inlet and the outlet of the exchanger tube are disposed outside of the housing of the heat exchanger. The coolant inlet and the coolant outlet are further disposed outside of the housing of the heat exchanger. The inlet and the outlet of the exchanger tube as well as the coolant inlet and the coolant outlet are then preferably disposed on one common housing portion such as a cover part that closes the housing of the heat exchanger. Particular advantages are obtained if the housing portion at which the inlet and the outlet of the exchanger tube as well as the coolant inlet and the coolant outlet are disposed simultaneously forms the common mechanical interface S of the heat exchanger of the invention.

In an advantageous implementation of the heat exchanger of the invention, the housing of the heat exchanger forms at least one housing cover and one housing case, the housing case being tightly closed by the housing cover. In this preferred exemplary embodiment, the housing portion on which the inlet and the outlet of the exchanger tube and the inlet and the outlet of the coolant are disposed is formed by the housing cover.

Preferably, the housing cover and the housing case are configured to be separate parts that may in particular be made from different materials. Housing cover and housing case are then joined together by means of mechanical retaining means such as screws, rivets or the like. At need, a seal may be added in order to realize an overall tightness of the housing consisting of housing case and housing cover.

In a particularly preferred implementation of the heat exchanger of the invention, the housing cover is configured to be a stamped part. It may for example be made from a sheet of corrosion resistant steel, aluminium or aluminium alloy. Concurrently, the housing case of the heat exchanger of the invention can be configured to be a cast part, for example made from gray cast iron or a diecast part made from aluminium, an aluminium alloy, magnesium or a magnesium alloy. This configuration of the housing case is optional, the housing case may for example also consist of several components that are welded or soldered together, e.g., of a corner steel tube with a bottom inserted by soldering and with a mounting flange adjoined by soldering.

Particular advantages are obtained if the coolant inlet and/or the coolant outlet are stamped into the housing cover, which is configured to be a stamped part. Concurrently, it is possible to form on the housing cover a bracing adjacent the coolant inlet and/or the coolant outlet, the bracing stiffening the housing cover at right angles to the plane of the adjacent inlet or outlet. Such a bracing can in particular be formed as a fold in the stamped housing cover, for example by beading a portion of the housing cover.

If the housing cover comprises the proposed bracings in the region of the coolant inlet and/or the coolant outlet, it is possible to completely eliminate undercuts on the housing case, which can be configured to be a cast part for example. This is due to the fact that it is not necessary for the housing case lying behind to support the housing cover in the region of the coolant inlet and/or the coolant outlet since, by virtue of the bracings proposed herein, the housing cover exhibits sufficient inherent stiffness in the regions in which forces prevail, which originate from the pressure of the coolant and deform the housing cover.

In another preferred implementation, the exchanger tube is designed so that a flow path forms in the exchanger tube, at least in its portion disposed inside the housing of the heat exchanger, the flow path running therein as a winding flow path including an angle of rotation a of at least 135°, preferably however an angle of rotation a of 180°. In the last configuration mentioned, heat exchangers with particularly high space savings can be realized.

Preferably, the exchanger tube is conducted in such a manner through the wall of the heat exchanger housing that a solid mechanical connection of the exchanger tube is obtained at the passage points through the housing wall. In an embodiment of the heat exchanger of the invention that is particularly easy to realize the exchanger tube is formed from one piece, at least between the passage points through the housing wall. Preferably however, it is configured to be a single-piece tube over its entire length between its inlet and its outlet.

In the previously mentioned configuration in which the flow path includes an angle of rotation a of 180°, the exchanger tube is preferably curved into a substantially U or semi-circular shape. This configuration of the exchanger tube is particularly efficient to manufacture and concurrently allows for efficient space occupancy of the inner volume of the heat exchanger housing.

In a preferred developed implementation, rather than one single exchanger tube there is provided a plurality of exchanger tubes that are disposed in the housing of the heat exchanger and form a bundle connected in parallel in terms of fluid flow. The flow paths forming in the exchanger tubes have preferably no contact to each other between their respective in- and outlets so that an increased number of flow cross section constrictions are avoided when passing through the exhaust path in the heat exchanger of the invention. This offers substantial advantages with respect to the pressure drop occurring in the exhaust gas heat exchanger and in particular also with respect to the deposits of residues originating from the combustion exhaust.

Preferably, the center points of the inlets or of the outlets of the exchanger tubes or of the passage points at which the exchanger tubes are conducted through the housing wall of the heat exchanger lie on grid points of an orthogonal or preferably hexagonal grid. In particular in the last mentioned configuration, particular high space occupancy inside the heat exchanger housing is obtained.

The exchanger tubes are preferably made from a corrosion and heat resistant material such as stainless steel, aluminium or an aluminium alloy and are configured to be thin-walled tubes.

Particular advantages are obtained if the housing portion on which the inlet and the outlet of the exchanger tube as well as the coolant inlet and the coolant outlet are disposed are made from the same material as the exchanger tube. If particularly high demands are placed on the heat load capacity of the exhaust gas heat exchanger of the invention, both the previously mentioned housing portion and the exchanger tube/the exchanger tubes are preferably made from stainless steel. If the thermal demands are slightly less, an implementation made from aluminium or from an aluminium alloy can be sufficient.

To conclude, it is noted that it is readily possible to have the coolant flowing through at least one exchanger tube of the heat exchanger of the invention. The medium to be cooled, which can be an exhaust gas flow of an internal combustion engine, then flows around the at least one exchanger tube inside the housing of the heat exchanger. Whether the coolant flows through the heat exchanger housing or is alternatively conducted through the one exchanger tube depends on the respective demands placed on the cooling performance of the heat exchanger of the invention. It is also noted that the flow direction both of the medium to be cooled and of the coolant was chosen arbitrarily in the following exemplary embodiments illustrated and can be adapted to the actual conditions of the specific case of application.

A heat exchanger of the invention is further suited for use as a charge air cooler in a motor vehicle having an internal combustion engine in which the combustion air is compressed through a compressor such as a turbocharger or a compressor to a pressure above atmospheric pressure. In particular, it is suited for use as a charge air cooler in connection with a low pressure exhaust gas recirculating system.

BRIEF DESCRIPTION OF THE DRAWINGS

The above, as well as other objects and advantages of the invention, will become readily apparent to those skilled in the art from reading the following detailed description of a preferred embodiment of the invention when considered in the light of the accompanying drawing which.

DETAILED DESCRIPTION OF THE INVENTION

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
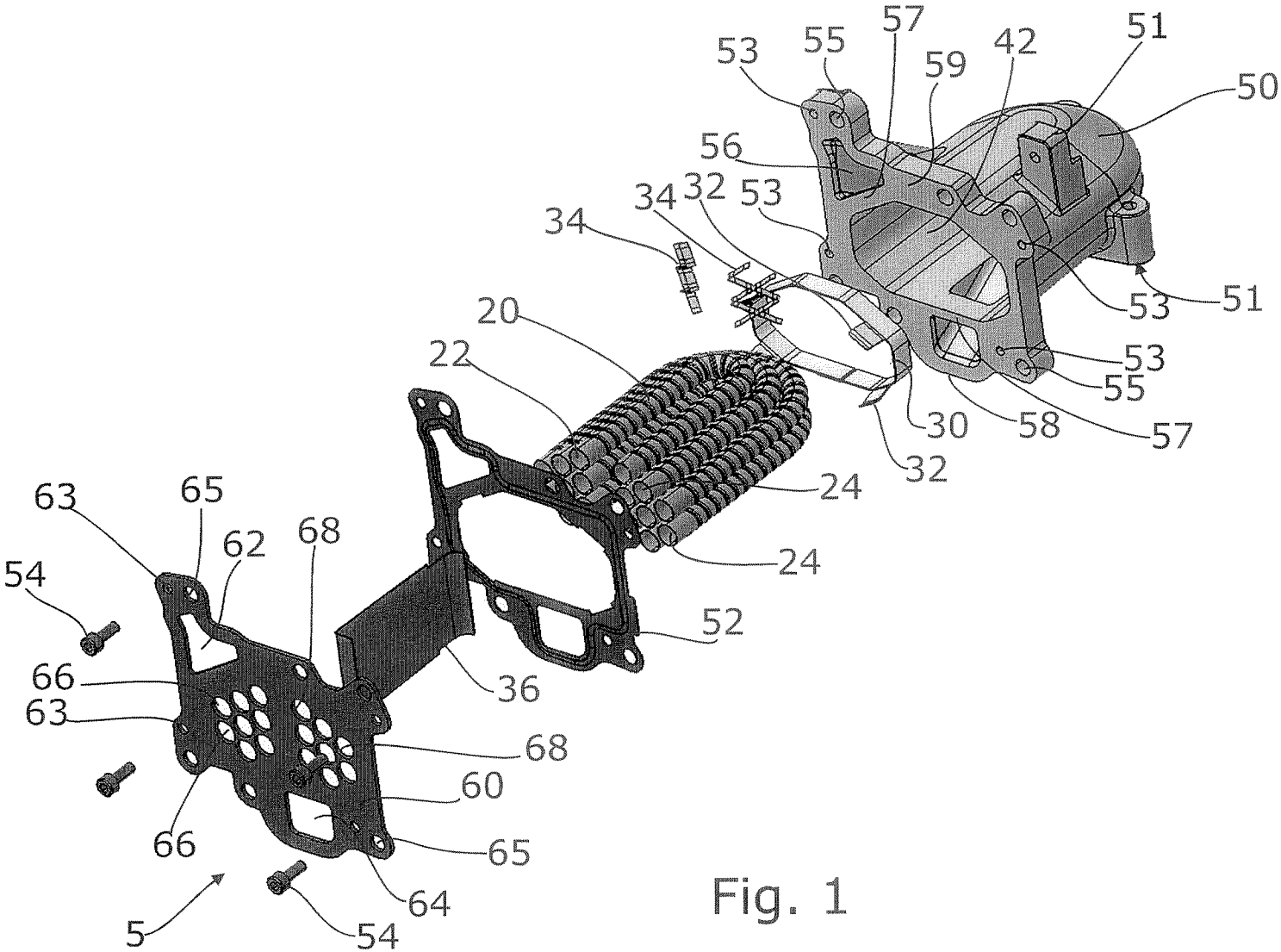
FIG. 1 shows an exploded view of a first exemplary embodiment of an exhaust gas heat exchanger of the invention.

FIG. 1 shows an exploded view of an exhaust gas heat exchanger 1 of the invention according to a first exemplary embodiment. The heat exchanger 1 includes a housing 40 consisting of a housing case 50 closed by means of a housing cover 60. The housing case 50 is configured to be a cast part and may be made from aluminium die casting in particular. Alternatively, the housing case 50 in the exemplary embodiment shown may be made from any material that can be processed by casting on the one side and that has sufficient thermal stability on the other side. Since the housing case 50 of the heat exchanger 1 of the invention only comes into touching contact with the coolant usually originating from the coolant circuit of the motor vehicle, a resistance to temperatures of up to 150° C. is sufficient for most of the cases of application. Magnesium or magnesium alloys, gray cast iron or also heat resistant and die-castable plastic materials have been found to be further materials suited for the housing case.

On the front side, the housing case 50 forms a flange 59 for connection to a housing cover 60. In the exemplary embodiment shown, the housing cover 60 consists of a punched steel plate having a thickness of a few millimeters, preferably of approximately 1-2 mm. The housing case 50 is connected for liquid and gas tight connection to the housing part 60, a seal 52, which, in the exemplary embodiment shown, is configured to be a metal bead seal, being inserted therein between. The housing cover 60 is thereby screwed to the flange 59 of the housing case 50 by means of screws 54. For this purpose, the housing case 50 forms a plurality of large threaded holes 55. At the corresponding positions, the housing cover 60 comprises through holes 65 of large diameter through which screws 54 of mating dimensions are threaded and inserted into the threaded holes 55 for the housing cover 60 to be screwed to the housing case 50.

The housing case 50 forms an inner volume 42 that is provided for accommodating therein a bundle of U-shaped exchanger tubes 20. The exchanger tubes 20 are identical with respect to their dimensions such as inner and outer diameter, but the opening width W (see FIG. 4) of the U-shaped profile varies. The shape of the inner volume 42 and as a result thereof of the housing case 50 is generally adapted to the shape of the bundle of exchanger tubes 20 so that the bundle of exchanger tubes 20 allows for using most efficiently the space in the inner volume 42.

At their respective ends, the exchanger tubes 20 each form an inlet 22 and an outlet 24. The ends of the exchanger tubes 20 are thereby conducted through corresponding holes in the housing cover 60, which form the passage points 66, 68 for the inlets 22 or the outlets 24 of the exchanger tubes 20. The inlets and outlets 22, 24 of the exchanger tubes 20 are thereby conducted through the holes formed in the housing cover 60. At the passage points 66, 68, the exchanger tubes 20 are connected for gas and liquid tight connection to the housing cover 60 such as by soldering or welding. As a result, the exchanger tubes 20 mechanically abut the housing cover 60.

In an embodiment, the exchanger tubes 20 consist of thin-walled stainless steel tubes. The exchanger tubes 20 are thereby provided with a stamped structure so that a raised spiral-shaped structure 26 is formed on the inner surface of the exchanger tubes 20. The bundle of exchanger tubes 20 is thereby disposed so that all the inlets 22 and all the outlets 24 are respectively arranged in one cohesive group for ease of connection of the heat exchanger 1 of the invention to the exhaust gas system of the motor vehicle for example. For this purpose, the front side of the housing cover 60 forms an assembly interface S that is configured in a substantially flange-like fashion due to the planar configuration of the housing cover 60. For mounting the heat exchanger 1 to the motor vehicle, further threaded holes 53 are formed in the housing case 50, the holes having a smaller diameter compared to the threaded holes 55. In the metal bead seal 52 as well as in the housing cover 60 there are formed corresponding through holes 63. Via these holes, the heat exchanger 1 can be connected to the exhaust gas and coolant system of the motor vehicle through a plurality of screws, which have not been illustrated in FIG. 1.

Beside the inner volume 42 accommodating the bundle of exchanger tubes 20, the housing case 50 forms an inlet channel 56 and an outlet channel 58 for a coolant; the coolant can be a cooling liquid from the cooling system of the internal combustion engine of the motor vehicle. The inlet channel 56 and the outlet channel 58 are thereby arranged for a flow path extending from the top to the bottom (in FIG. 1) to form through the inner volume 42 of the housing case 50 when the heat exchanger 1 is operated according to the use it was intended for so that the bundle of exchanger tubes 20 is intensively flooded by the coolant. In order to achieve as intensive as possible an interaction between the coolant and the surface of the exhaust gas carrying exchanger tubes 20, a baffle plate 36 is disposed within the legs of the U-shaped exchanger tubes 20, the baffle plate being again preferably made from stainless steel in the exemplary embodiment shown and being butt soldered or butt welded to the housing cover 60 also made from stainless steel. The baffle plate 36 lengthens the flow path of the coolant in the inner volume 42 of the housing 40, thus ensuring a more intensive thermal exchange between the exhaust gas flowing in the exchanger tubes 20 and the coolant flowing in the inner volume 42.

The inlet channel 56 as well as the outlet channel 58 formed in the housing case 50 also end in the flange 59 formed by the housing case 50, webs 57 being formed at the ends of the channels 56 and 58 for forming a mechanical abutment for the metal bead seal 52 resting on the flange 59. The seal also forms passageways for the coolant flowing through the heat exchanger 1, which correspond to the coolant inlet 62 and the coolant outlet 64 formed in the housing cover 60. In the assembled heat exchanger 1, coolant can be both supplied through the coolant inlet 62 and evacuated through the coolant outlet 64 and the combustion exhaust gas to be cooled can be supplied through the inlets 22 of the exchanger tubes 20 and evacuated through the outlets 24 via the front side of the housing cover 60. In the construction shown, this is possible through one single common mounting interface S.

Figure 2:
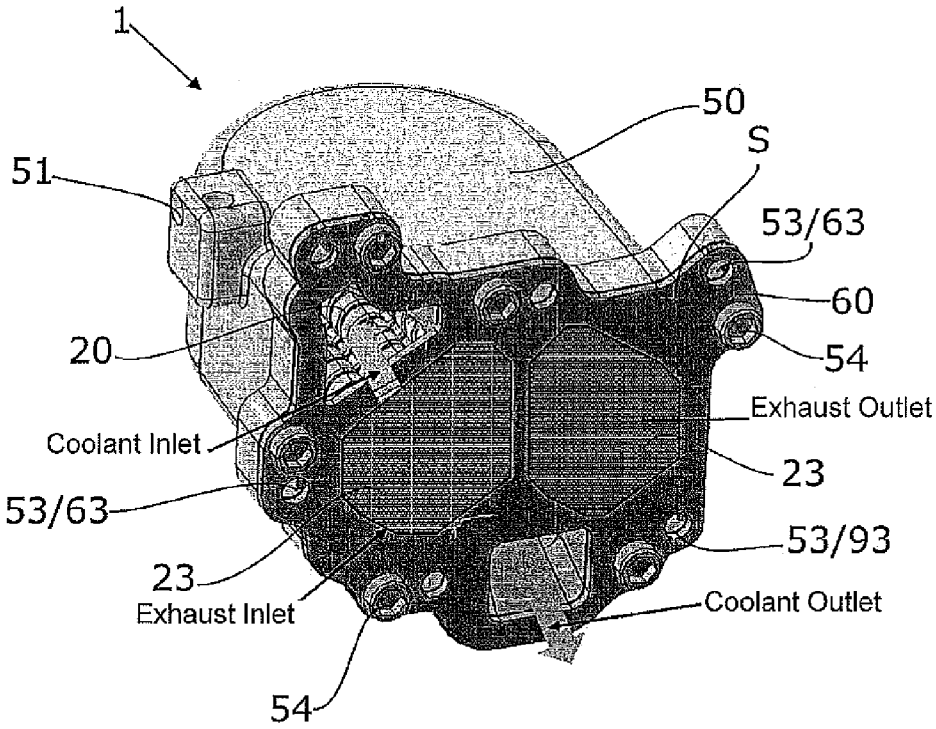
FIG. 2 is an elevational view of the mounting interface S of an exhaust gas heat exchanger according to a second exemplary embodiment.

This is particularly obvious from the illustration shown in FIG. 2 which shows an elevation view of a mounting interface S of the heat exchanger 1 in a slightly altered embodiment. The coolant inlet 62 formed in the housing cover 60 and the coolant outlet 64 are clearly visible. By contrast, the majority of inlets 22 and outlets 24 of the exchanger tubes 20 is covered by grid structures 23 in the illustration shown in FIG. 2. The arrangement of the inlets 22 and of the outlets 24 in the housing cover 60 substantially corresponds to the configuration shown in FIG. 1. For the rest, the heat exchanger shown in the illustration of FIG. 2 substantially differs by the modified arrangement of fastening points 51 to the housing case 50, these fastening points 51 serving to fasten the heat exchanger 1 to mounting structures of the motor vehicle.

Figure 3:
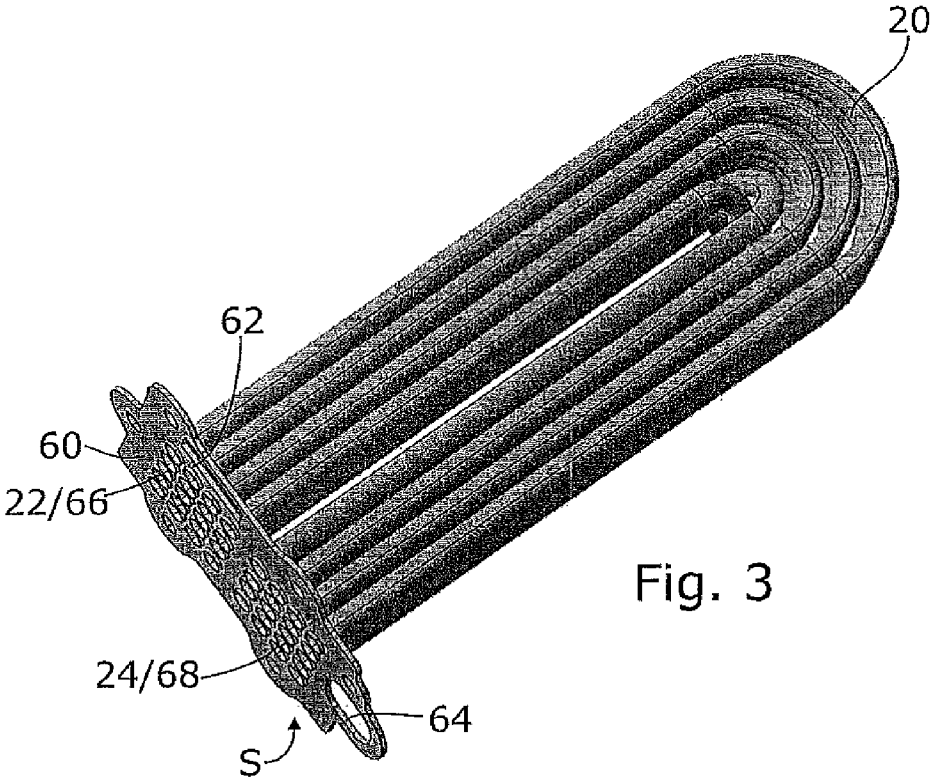
FIG. 3 is an elevational view of a bundle of exchanger tubes of an exhaust gas heat exchanger according to a third exemplary embodiment.

FIG. 3 shows a perspective illustration of a bundle of exchanger tubes 20 of a heat exchanger 1 in a third implementation. As compared to the heat exchanger 1 shown in FIG. 1, the bundle of exchanger tubes 20 shown herein substantially differs by the fact that the exchanger tubes 20 are smooth, e.g., seamless drawn thin-walled stainless steel tubes that have no spiral-shaped structure 26 like the one shown in FIG. 1. Furthermore, the exchanger tubes 20 are arranged so as to intersect by pairs, this being visible at the inversion points of the U-shaped exchanger tubes 20 in FIG. 3

In FIG. 1 it can be further seen how undesirable oscillations of the bundle of exchanger tubes 20 in the inner volume 42 of the housing 40 can be prevented by means of technical measures. The baffle plate 36, which is connected for mechanical rigid connection to the housing cover 60 and is disposed within the bundle of exchanger tubes 20, is connected at its sidewall and at its bent tip to the neighbouring exchanger tubes 20 such as by soldering or welding for a mechanical solid connection. The baffle plate 36 thus mechanically stiffens the exchanger tubes 20 of the exchanger tube bundle lying inside, thus attenuating their oscillations.

As an additional measure to reduce the oscillations there is provided a bandage 30 made from a stamped stainless steel sheet of small wall thickness. This bandage completely surrounds the bundle of the exchanger tubes 20 and is connected at the contact points to the neighbouring exchanger tubes 20 for mechanical solid connection such as by means of welding or soldering. Thanks to the arrangement surrounding the bundle of exchanger tubes, the bandage 30 prevents relative oscillations of the outside lying exchanger tubes 20 relative to each other. Moreover, the bandage 30 forms integrally formed abutments 32 that consist of angled projections. These abutments 32 resiliently support the entire bundle of exchanger tubes with respect to the inner wall of the housing 40.

Finally, stiffening elements 34 are arranged within the bundle of exchanger tubes 20, which also are made from stamped stainless steel strips. These stiffening elements 34 constitute a mechanically rigid abutment of the exchanger tubes 20 of the bundle of exchanger tubes. For this purpose, they are connected to the exchanger tubes 20 for mechanical solid connection such as by means of welding or soldering.

It is noted that the mechanical solid connection of the bandage 30 or of the stiffening elements 34 to the discrete exchanger tubes 20 can be eliminated. Possibly, the mere interlock between the bundle of exchanger tubes and the bandage 30 or the stiffening element 34 may already provide for sufficient abutment of the bundle of exchanger tubes and for the bandage 30 or the stiffening elements 34 to sit sufficiently solidly on the bundle of exchanger tubes.

Figure 4:
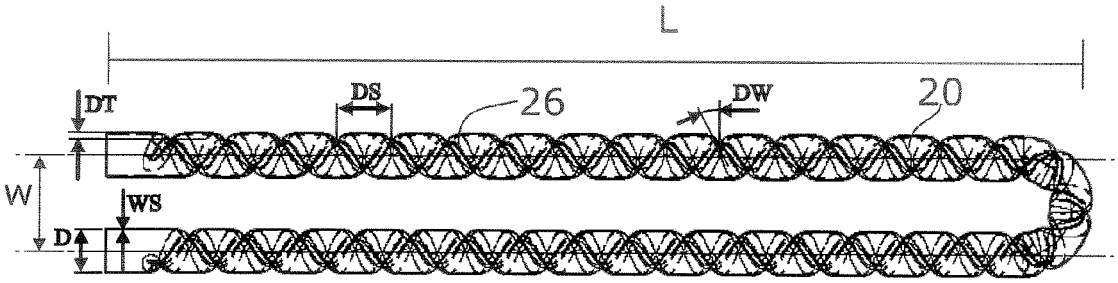
FIG. 4 is a schematic illustration of an exchanger tube of the heat exchanger according to FIG. 1.

FIG. 4 now shows an elevation view of one exchanger tube 20 of the heat exchanger 1 according to the first exemplary embodiment. The exchanger tube 20 has a free length indicated at L that can range between 2 and 30 cm depending on the dimensions of the heat exchanger 1; if used in motor vehicles with an internal combustion engine of less output (typically 35-100 kW), appropriate typical dimensions of L are of about 5 cm. For private cars of higher output of 100 kW and more, dimensions of L ranging between 10 and 15 cm may be sensible. For use in trucks, dimensions of L=20 cm and more may be suited.

Figure 5:
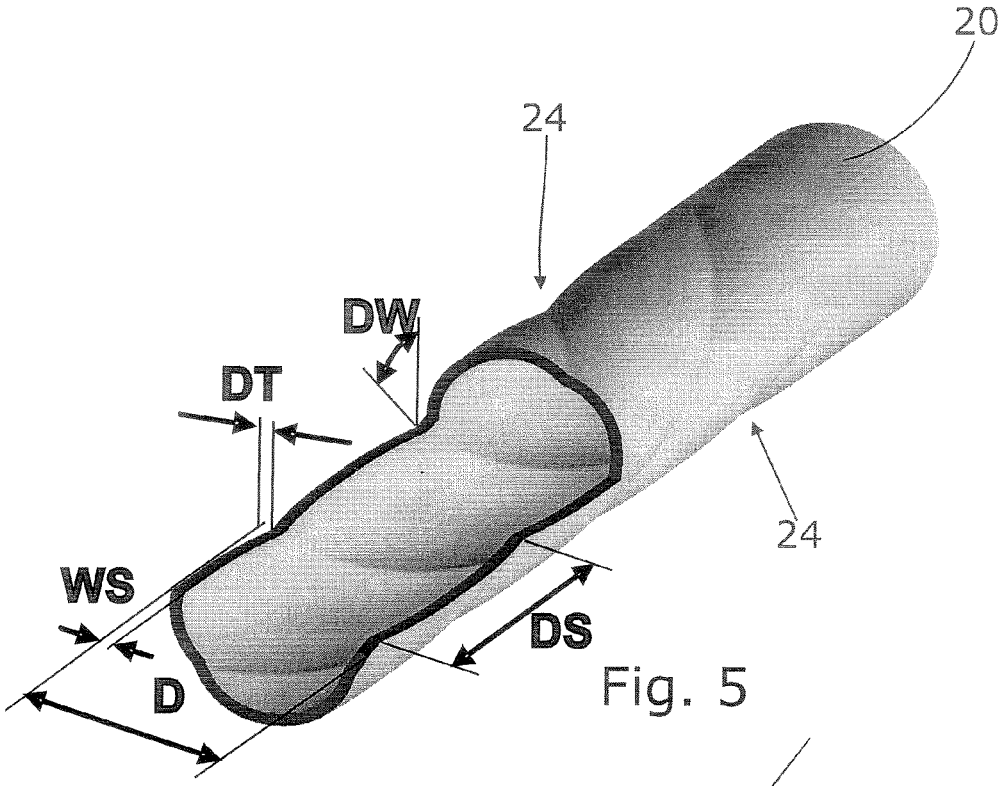
FIG. 5 is a sectional view through the exchanger tube shown in FIG. 4.

The exchanger tube 20 has an outer diameter D that typically ranges between 1 and 15 mm, preferably between 6 and 12 mm, since this diameter has been found particularly suited for using the heat exchanger in accordance with its purpose of utilization as an exhaust gas heat exchanger for a motor vehicle. As can be seen in FIG. 4 and in FIG. 5, which constitutes a perspective sectional view of the exchanger tube 20 of FIG. 4, values ranging from 0.1 to 1 mm are suited for the wall thickness WS of the exchanger tubes 20, depending in particular also on the length L of the exchanger tube 20 in the specific heat exchanger 1. Preferably, the wall thickness WS of the exchanger tubes 20 ranges from 0.2 through 0.6 mm.

For the spacing W between the legs of the U-shaped exchanger tubes 20, it has been found out that this spacing is preferably greater than or equal to twice the outer diameter D of the exchanger tube 20. The following applies in particular: W is greater than or equal to 2.2×D, and it has been found out that the leg width W, which is directly correlated to the bending radius R of the U-shaped exchanger tube 20, is greater than W=2R, if the exchanger tube 20 used is a thin-walled tube, for example made from stainless steel or aluminium, provided with a continuous spiral structure 26. A particularly small leg width W is of benefit for most efficient possible occupancy of the inner volume of the housing 40 and is to be preferred due to the very limited space available in a motor vehicle.

Within the frame of practical testing it has been found out that particularly advantageous properties with respect to generating a turbulence in the exhaust gas flowing through the exchanger tube 20 and as a result thereof a particularly intensive heat transfer from the exhaust gas to the wall of the exchanger tube are achieved if the exchanger tube 20 comprises a spiral structure 26 at least on its inner wall. The spacing DS between the windings of the spiral structure 26 advantageously ranges between 1 and 15 mm, with a range of between 4 and 8 mm being preferred. The resulting pitch is indicated at DW in FIG. 4. The height DT of the raised spiral structure 26 on the inner wall of the exchanger tube 20 advantageously ranges between 1 and 20% of the outer diameter D of the respective exchanger tube 20, with a range of between 2.5 and 14% being preferred here.

If a plurality of exchanger tubes 20 is provided for a bundle of exchanger tubes to form, it has been found out that the efficiency achievable if the heat exchanger is used according to its purpose of utilization is particularly high if the minimum distance d between the outer surfaces of the respective exchanger tubes 20 of the bundle of exchanger tubes ranges between 0.5 and 5 mm. A range of between 1 and 2 mm is preferred here, since it yields particularly good results with respect to efficiency if water is used as the coolant.

In an embodiment of the invention, the spiral structure 26 in the exchanger tube 20 is not only formed on the inner surface of the exchanger tube 20. Instead, the spiral structure 26 is produced by stamping a spiral shape into the outer surface of the exchanger tube 20, which results in a stamped raised spiral structure 26 on the inner surface of the exchanger tube 20.

Figure 6:
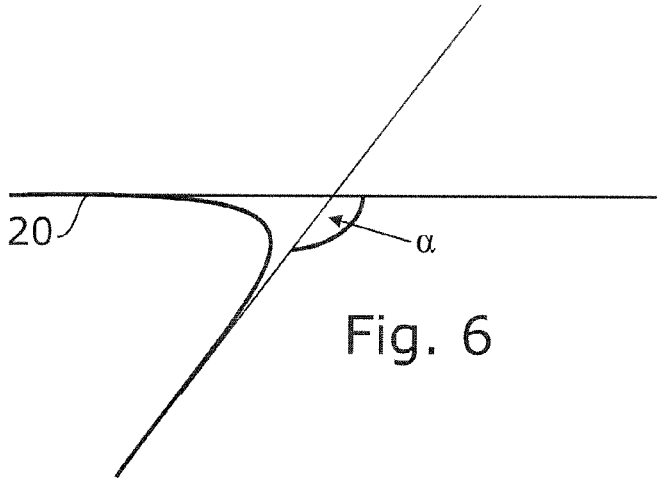
FIG. 6 is a schematic illustration of an exchanger tube forming a winding flow path for illustrating the angle of revolution α.

FIG. 6 schematically shows the angle of rotation a that is surrounded by the flow path forming in the exchanger tube 20. In the preferred embodiments of the heat exchanger 1 of the invention, this angle of rotation $\alpha$=180°, i.e., the flow direction of the exhaust gas flow exiting the inner volume 42 of the heat exchanger 1, is 180° opposite the flow direction of the entering exhaust gas flow. In other configurations, the angle of rotation a may however be smaller or greater than 180°, an angular range of between 135° and 225° being generally preferred. The use of exchanger tubes 20 forming a spiral structure 26 on their inner surface has already been found to increase efficiency at an angle of rotation $\alpha$ of 45°.

Figure 7:
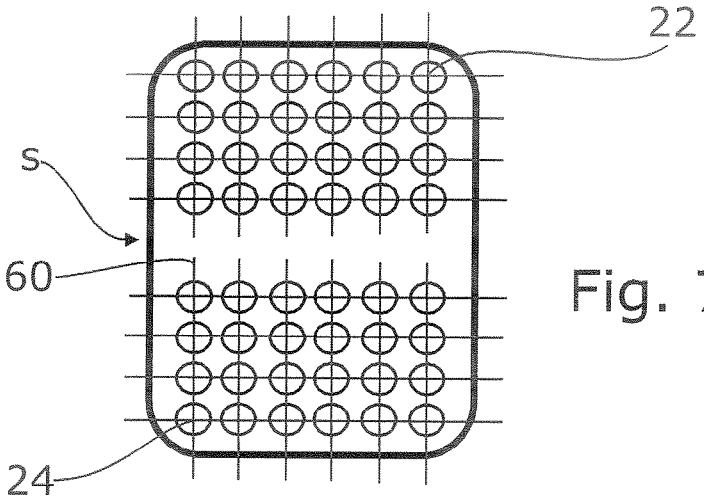
FIG. 7 is an elevational view of the interface S formed by a housing cover in which the inlet and the outlet openings are disposed on grid places of an orthogonal grid.

FIG. 7 schematically shows once more an elevation view of the inlets 22 and the outlets 24 of a plurality of exchanger tubes 20 that are arranged in a bundle in the inner volume 42 of a heat exchanger housing 40. It appears that both the inlets 22 and the outlets 24 are disposed on the grid points of an orthogonal grid.

Figure 8:
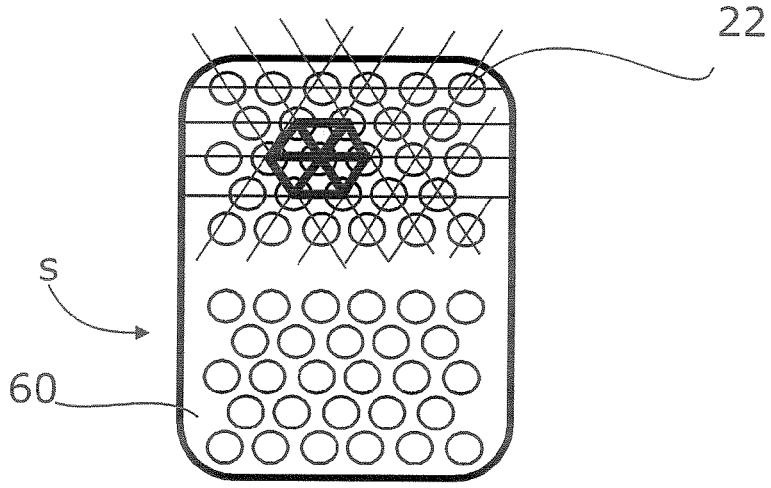
FIG. 8 is an elevational view of the interface S formed by a housing cover in which the inlet and the outlet openings are disposed on grid places of a hexagonal grid.

An even more efficient space occupancy is obtained if the inlets 22 and outlets 24 are arranged as shown in FIG. 8. Here, the inlets 22 or outlets 24 are disposed on grid points of a hexagonal grid, which means that each inlet 22 or each outlet 24 is surrounded by six neighbouring inlets 22 or outlets 24. In this configuration, the space inside the inner volume 42 of the housing 40 can be best used for the exchanger tubes 20.

Figure 9:
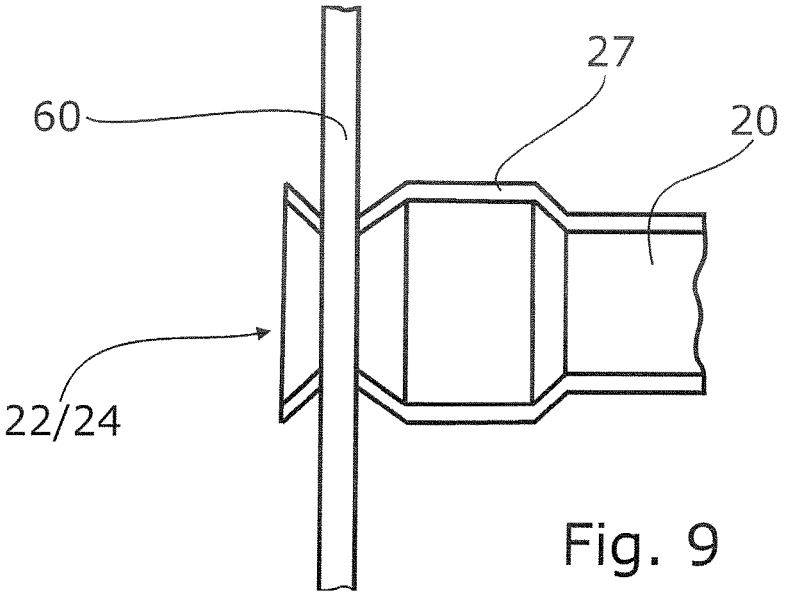
FIG. 9 is a section view through an inlet/outlet opening of an exchanger tube in the region of a housing cover.

FIG. 9 shows a sectional view of a housing cover 60 in the region of a hole through which the inlet or outlet side end 22/24 of an exchanger tube 20 is threaded. In a preferred implementation, which offers particular advantages for manufacturing, the exchanger tube 20 comprises at its inlet or outlet side end 22/24 a supporting structure 27 that forms a mechanical abutment of the tube end with respect to the housing cover 60. This supporting structure may for example be formed from one or several dot-shaped projections, in the exemplary embodiment shown in FIG. 4 it is stamped as a circumferential bulge. In the exemplary embodiment shown in FIG. 9, the outer end of the exchanger tube 20 is beaded so that, generally, the exchanger tube 20 mechanically abuts the housing cover 60 through the combination of supporting structure 27 and beaded end. This abutment substantially facilitates the manufacturing of the heat exchanger of the invention since the exchanger tubes 20 are already pre-fixed mechanically in the housing cover 60. This dispenses with the need for additionally fixing the exchanger tubes 20 to the housing cover 60 such as by means of laser welding spots during subsequent soldering or welding of the exchanger tube ends to the housing cover 60. The structures shown in FIG. 9 may be made in the simplest way in the exchanger tube end by threading an exchanger tube 20 with uniform inner and outer diameter through the corresponding hole in the housing cover 60. After that, the circumferential bulge 27 and at the same time the beaded edge is produced using an appropriate tool. This appropriate tool is for example a tube expansion tool.

Figure 10A:
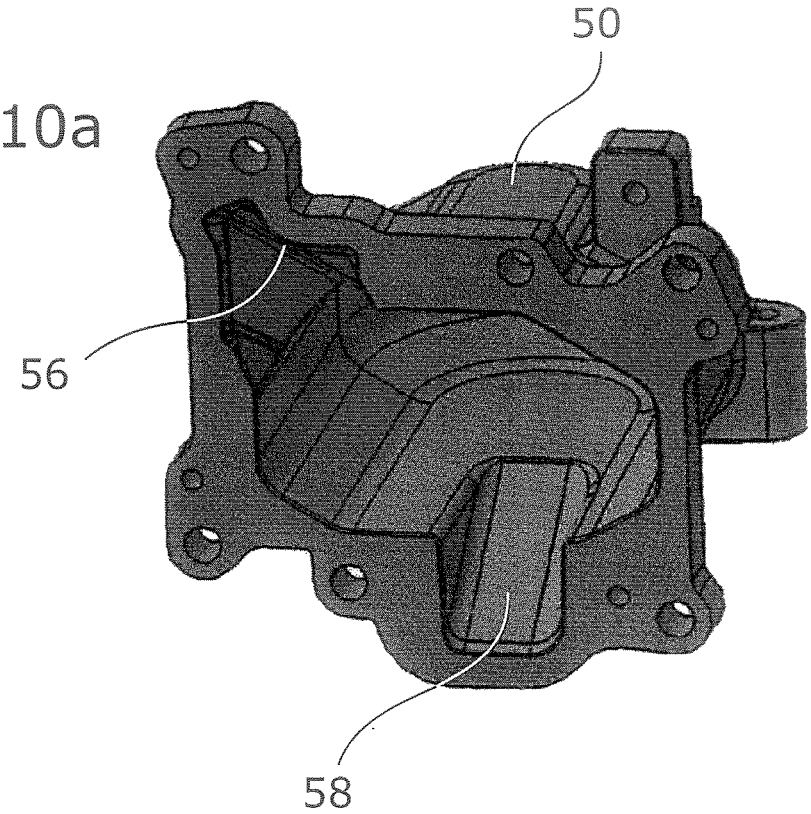
FIG. 10*a* is a perspective view of a housing case of a fourth exemplary embodiment of an exhaust gas heat exchanger of the invention.

FIG. 10*a* shows the housing case 50 of a fourth exemplary embodiment of a heat exchanger 1 of the invention. Here also, the housing case 50 is configured to be a cast part, for example an aluminium diecast part or a part made from gray cast iron.

Figure 10B:
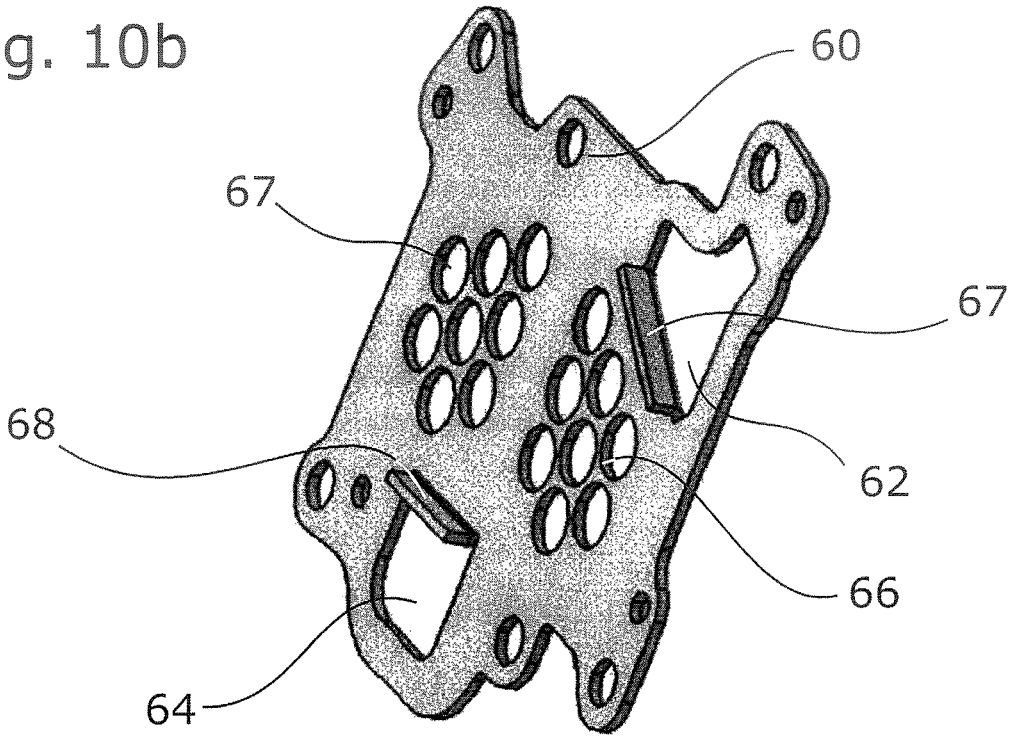
FIG. 10*b* is a perspective view of an associated housing cover.

FIG. 10*b* shows the associated housing cover 60 that can be a stamped part made from a sheet of stainless steel or from another corrosion protected steel or from a sheet of aluminium. As shown in the exemplary embodiment shown in FIG. 1, a plurality of passage points 66 and 68 for a plurality of exchanger tubes 20 is formed in the housing cover 60. Moreover, a coolant inlet 62 and a coolant outlet 64 are formed, which also lie opposite an inlet channel 56 and an outlet channel 58 in the housing case 50 (see FIG. 10*a*) like in the exemplary embodiment shown in FIG. 1. As contrasted with the exemplary embodiment 1, neither the inlet channel 56 nor the outlet channel 58 have webs 57 formed thereon, i.e., the housing case 50 has no undercuts so that significant advantages are obtained in terms of production. In order to achieve the abutment needed for the housing cover 60 configured to be a stamped part in the region of the coolant inlet 62 as well as of the coolant outlet 64, bracings 67 are formed on the housing cover 60. In the exemplary embodiment shown, they are formed as folds on the housing cover 60, i.e., they are made by beading defined regions of the housing cover 60 so that they are integral with the housing cover 60. In an alternative implementation, it is of course also possible to form the bracings 67 as separate parts, for example as sheet steel portions, which are welded or soldered or mechanically fixed to the housing cover 60 in another way. Since in the fourth exemplary embodiment shown herein the housing case 50 has no undercuts, it can be made particularly readily, for example as a cast part, this allowing for significant cost advantages. The bracings 67, which by contrast are optional, are already to be formed together with the housing cover 60, when the latter 60 is being cut out, this resulting in virtually no increase in the manufacturing costs.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A heat exchanger for an exhaust gas system of a motor vehicle comprising:

a closed housing including a housing cover and at least one housing case, the housing cover substantially closing the housing case, the housing cover having a common mechanical interface for connecting the heat exchanger to the exhaust gas system and a coolant circuit of the motor vehicle, wherein the housing cover includes a coolant inlet and a coolant outlet;

a bundle of substantially U-shaped exchanger tubes disposed in the housing, wherein each of the exchanger tubes includes a first leg having a first end provided with an inlet and a second leg having a second end provided with an outlet, an outer surface of each of the exchanger tubes forming a substantially fluid tight seal with the housing cover, wherein a coolant flows through the housing and around an outer surface of the exchanger tubes; and a seal disposed between the at least one housing case and the housing cover forming a substantially fluid tight seal therebetween, wherein the seal includes a plurality of passageways formed therein, the passageways corresponding to the coolant inlet and the coolant outlet of the housing cover.

2. The heat exchanger as set forth in claim 1, wherein at least one of the first end and the second end of at least one of the exchanger tubes extends through and beyond the housing cover.

3. The heat exchanger as set forth in claim 1, wherein the housing cover and the at least one housing case are separate parts joined together by a mechanical retaining means.

4. The heat exchanger as set forth in claim 1, wherein the housing cover is formed as a stamped part.

5. The heat exchanger as set forth in claim 1, wherein at least one of the coolant inlet and the coolant outlet is stamped in the housing cover.

6. The heat exchanger as set forth in claim 1, further comprising a brace formed adjacent at least one of the coolant inlet and the coolant outlet, wherein the brace stiffens the housing cover.

7. The heat exchanger as set forth in claim 6, wherein the brace is formed by a folded portion of the housing cover.

8. The heat exchanger as set forth in claim 1, wherein the at least one housing case is formed as a cast part.

9. The heat exchanger as set forth in claim 1, wherein at least one of the exchanger tubes is substantially made from one piece between points at which the exchanger tube forms a seal with the housing.

10. The heat exchanger as set forth in claim 1, wherein the exchanger tubes are connected in parallel in terms of fluid flow.

11. The heat exchanger as set forth in claim 1, wherein a flow path of one of the exchanger tubes has no contact with a flow path of another one of the exchanger tubes between points at which the exchanger tubes form a seal with the housing.

12. The heat exchanger as set forth in claim 1, wherein the exchanger tubes form a hexagonal grid at points at which the exchanger tubes form a seal with the housing.

13. The heat exchanger as set forth in claim 1, wherein at least one of the exchanger tubes is made from a corrosion and heat resistant material.

14. The heat exchanger as set forth in claim 1, wherein the housing cover and at least one of the exchanger tubes are produced from the same material.

15. The heat exchanger as set forth in claim 1, wherein the seal is a metal bead seal.

* * * * *